US006502668B1

(12) United States Patent
Chida et al.

(10) Patent No.: US 6,502,668 B1
(45) Date of Patent: Jan. 7, 2003

(54) TOUCH PANEL WITH CLICK BUTTON FOR ELEVATOR

(75) Inventors: Akihiro Chida, Tokyo (JP); Mitsuhiko Yamamoto, Tokyo (JP); Masayuki Miyawaki, Tokyo (JP); Yasuyuki Tamaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 332 days.

(21) Appl. No.: 10/009,751

(22) PCT Filed: Jun. 20, 2000

(86) PCT No.: PCT/JP00/04016

§ 371 (c)(1),
(2), (4) Date: Dec. 12, 2001

(87) PCT Pub. No.: WO01/98190

PCT Pub. Date: Dec. 27, 2001

(51) Int. Cl.[7] ..... B66B 1/34; B66B 3/00
(52) U.S. Cl. ..... 187/395; 187/391
(58) Field of Search ..... 187/395, 394, 187/380, 413, 901, 384, 391, 397; 200/512, 502, 600

(56) References Cited

U.S. PATENT DOCUMENTS 4,805,739 A * 2/1989 Lind et al. ..... 187/394
5,243,162 A * 9/1993 Kobayashi ..... 200/5 A
5,587,567 A * 12/1996 Winter et al. ..... 187/395
5,679,934 A * 10/1997 Juntunen et al. ..... 187/384
5,914,466 A * 6/1999 Durand ..... 187/391
5,969,306 A * 10/1999 Velauthapillai et al. ..... 187/395
5,975,247 A * 11/1999 Choi ..... 187/380
6,161,654 A * 12/2000 Sirigu et al ..... 187/391
6,161,655 A * 12/2000 Lejon et al. ..... 187/388
6,227,335 B1 * 5/2001 Koeppe et al. ..... 187/395

FOREIGN PATENT DOCUMENTS

| | | | | |
|---|---|---|---|---|
| JP | 405147842 A | * | 5/1993 | ..... B66B/1/46 |
| JP | 04-324716 | | 5/1994 | |
| JP | 406144726 A | * | 5/1994 | ..... B66B/1/50 |
| JP | 406191753 A | * | 6/1994 | ..... B66B/3/00 |
| JP | 7-210283 | | 8/1995 | |
| JP | 10-245166 | | 9/1998 | |
| JP | 2000-156130 | | 6/2000 | |
| JP | 2000-156134 | | 6/2000 | |
| TW | 363611 | | 7/1999 | |

* cited by examiner

*Primary Examiner*—Johathan Salata
(74) *Attorney, Agent, or Firm*—Leydig, Voit & Mayer, Ltd.

(57) ABSTRACT

In an operating panel for an elevator, a button is located at a touch panel. A button frame is disposed over a display surface member of the button, a button cap is embedded within a button accommodating portion of the button frame. The button portion is operated by pushing the button cap. A metal dome member generated a click feeling at the time of operation is located between accommodating portion and the button cap.

4 Claims, 5 Drawing Sheets

TOUCH PANEL WITH CLICK BUTTON FOR ELEVATOR

TECHNICAL FIELD

The present invention relates to an operating panel for an elevator which has a touch panel portion and which is disposed in a car or an elevator hall.

BACKGROUND ART

Conventionally, as disclosed, for example, in Japanese Patent Application Laid-Open No. Hei 6-144726, a car operating panel for an elevator uses a touch panel which is operated by being touched by a passenger's finger.

However, in such an operating panel, since the display surface of the touch panel is touched directly, the display surface is easily soiled, thereby requiring much time and labor for maintenance such as cleaning or the like. Further, since input to the touch panel is not accompanied by a button like click feeling, there is a fear that passengers used to pushing buttons may be anxious about whether the operation has been input or not.

DISCLOSURE OF THE INVENTION

The present invention is made to solve the problems mentioned above, and an object of the present invention is to provide an operating panel for an elevator, wherein maintenance can be facilitated and a click feeling can be obtained at the time of operation while using a touch panel.

To this end, according to one aspect of the present invention, there is provided an operating panel for an elevator comprising an operating panel body, and a touch panel portion including a button portion for inputting information, provided at a front surface of the operating panel body, wherein the button portion includes: a display surface member; a button frame disposed with an interval provided between a surface of the display surface member, the button frame having a button accommodating portion; a button cap embedded within the button accommodating portion, the button cap being operated by being pushed; and a dome member made of metal and provided between the button accommodating portion and the button cap, the dome member being deformed by being pressed by the button cap when the button cap is pushed and being restored when the button cap is released.

BEST MODE FOR CARRYING OUT THE INVENTION

Preferred embodiments of the present invention will be described below with reference to the accompanying drawings.

FIRST EMBODIMENT

Figure 1:
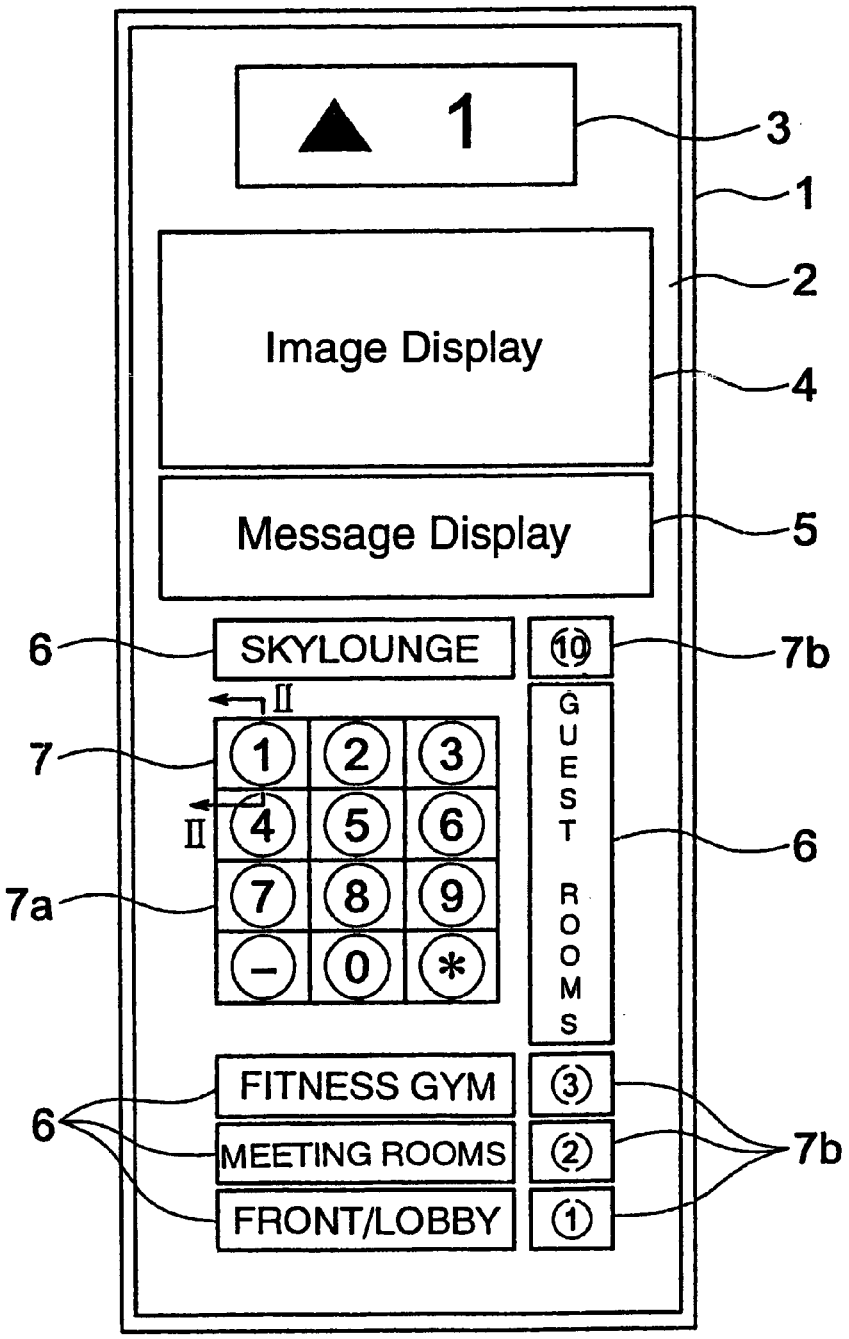
FIG. 1 is a front view showing an operating panel for an elevator according to a first embodiment of the present invention.

FIG. 1 is a front view showing an operating panel for an elevator according to a first embodiment of the present invention. In the figure, a touch panel portion (touch screen) 2 is provided at a front surface of an operating panel body 1. A car direction/position display portion 3 is disposed in an area at an upper end portion of the touch panel portion 2. An image display portion 4 for displaying images is disposed at an area below the direction/position display portion 3. A message display portion 5 for displaying text messages is disposed at an area below the image display portion 4.

Floor information display portions 6 for displaying information of corresponding floors and a button portion 7 for inputting information are disposed at an area below the message display portion 5. The button portion 7 has a ten-key numerical input portion 7*a* and destination floor registering portion 7*b*.

Figure 2:
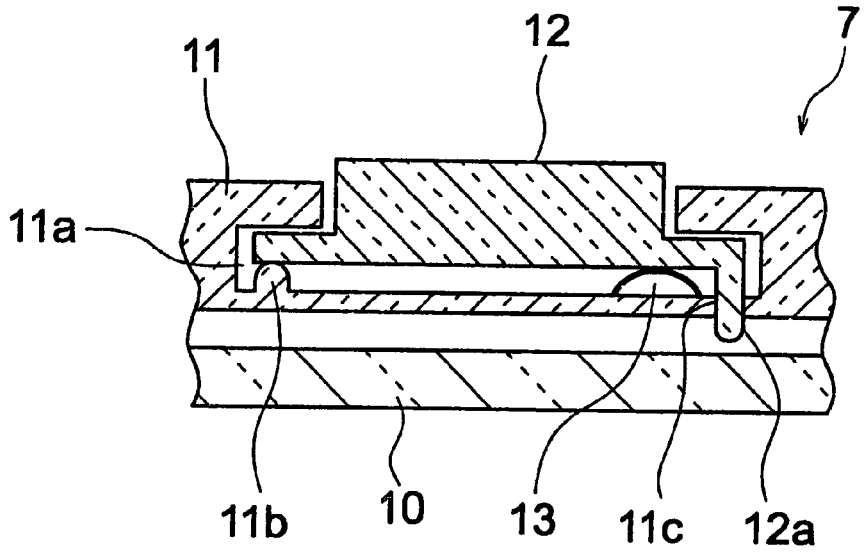
FIG. 2 is a cross-sectional view taken along the line II—II in FIG. 1.

Next, FIG. 2 is a cross-sectional view taken along the line II—II in FIG. 1. A transparent button frame 11 made of resin is disposed over a display surface member 10 in the button portion 7. The button frame 11 is fixed to the display surface member 10 or an outer frame or the like of the operating panel body 1 so as to maintain an interval between itself and the surface of the display surface member 10.

The button frame 11 is provided with a button accommodating portion (recess portion) 11*a*. A fulcrum projection 11*b* and a through hole 11*c* are provided at the bottom portion of the button accommodating portion 11*a*.

A button cap 12 made of transparent plastic, which is operated by being pushed is embedded within the button accommodating portion 11*a*. The button cap 12 is provided with an operation projection 12*a* inserted into the through hole 11*c*.

Figure 3:
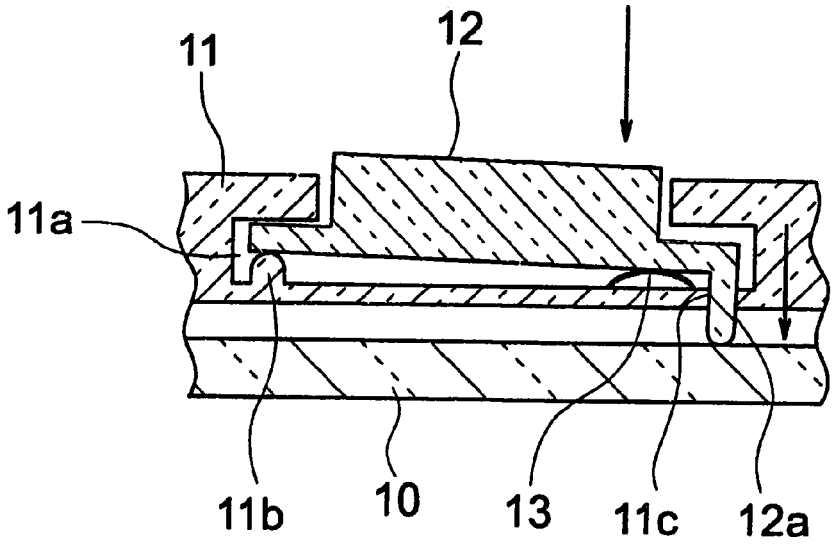
FIG. 3 is a cross-sectional view showing the state where the button cap in FIG. 2 is pushed.

A dome member 13 made of metal is provided between the bottom portion of the button accommodating portion 11*a* and the backside the button cap 12. As shown in FIG. 3, the dome member 13 is deformed by being pressed by the button cap 12 when the button cap is pushed to generate a click feeling. Further, the dome member restores itself without any external force when the button cap is released.

In such an operating panel for an elevator, when the button cap 12 is pushed to displace as shown in FIG. 3 at the time of operating the button portion 7, the dome member 13 is deformed to give the click feeling to the operator. Further, the operation projection 12*a* is moved to the display surface member 10 side by the movement of the button cap 12 to input the operation.

While, in one type of the touch panel portion 2, the operation is input at this time by contacting the operation projection 12*a* with the display surface member 10, in other types, the operation is input by intercepting light or ultrasonic waves by the movement of the operation projection 12*a*. The present invention is applicable to various types of touch panel portions 2.

As described above, since the dome member 13 is disposed between the button accommodating portion 11*a* and the button cap 12, click feelings can be obtained at the time of operation while using a touch panel. Also, durability can be improved by using the dome member 13 made of metal. Further, since the dome member 13 is used only for giving the click feeling and is separated from the display surface member 10, the dome member 13 does not have any negative electrical influence when the button portion 7 is operated.

More, since the button portion 7 is operated by the button cap 12 without directly touching the display surface member

10, the display surface member 10 is difficult to soil. Also, if the button cap 12 becomes soiled, the button cap 12 alone can be cleaned or replaced, thereby facilitating maintenance.

Furthermore, since the button frame 11 and the button cap 12 are transparent, variations can be applied to characters and typefaces of the buttons displayed at the display surface member 10, thereby extending the range of the design.

SECOND EMBODIMENT

Figure 4:
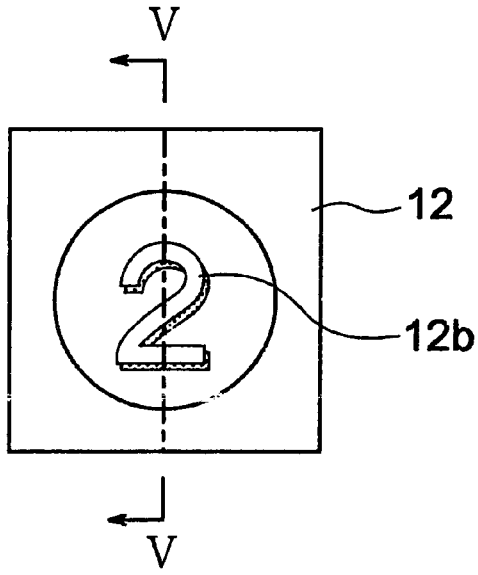
FIG. 4 is a front view showing a button cap according to a second embodiment of the present invention.
Figure 5:
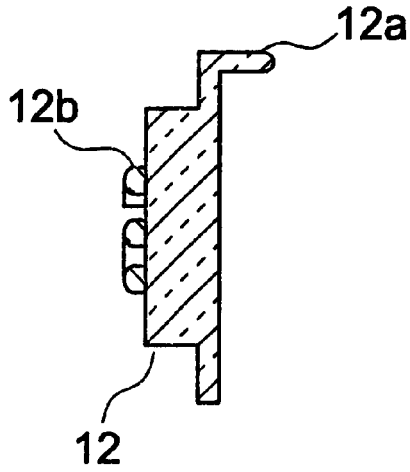
FIG. 5 is a cross-sectional view taken along the line V—V in FIG. 4.

Next, FIG. 4 is a front view showing a button cap according to a second embodiment of the present invention, and FIG. 5 is a cross-sectional view taken along the line V—V in FIG. 4. In the figures, a character 12*b* configured by a projection is provided on the surface of the button cap 12. The other constructions are the same as in the first embodiment.

In the conventional touch screen, since there is no concave-convex on the surface of the display, operations by the visually impaired is difficult. In contrast, by providing the characters 12*b* configured by the projections on the surfaces of the button caps 12, the buttons can easily be selected by the visually impaired and performance of operations can be clearly recognized by the click feelings.

THIRD EMBODIMENT

Figure 6:
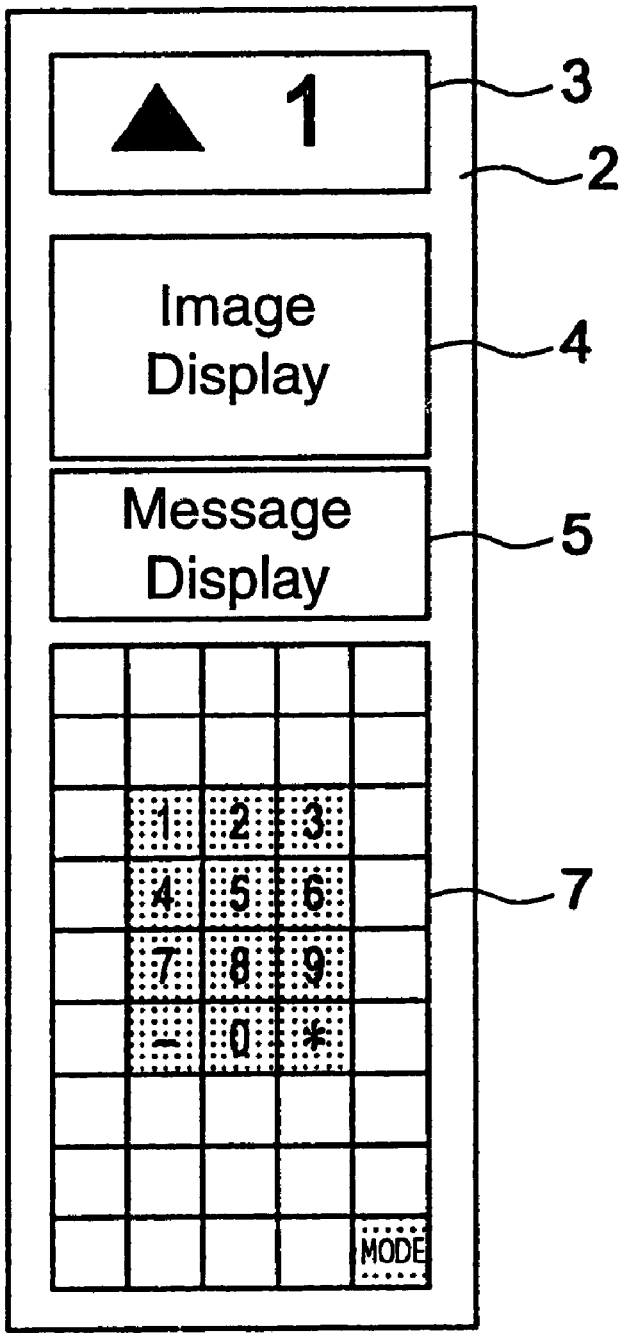
FIG. 6 is a front view showing a touch panel portion of an operating panel according to a third embodiment of the present invention.
Figure 7:
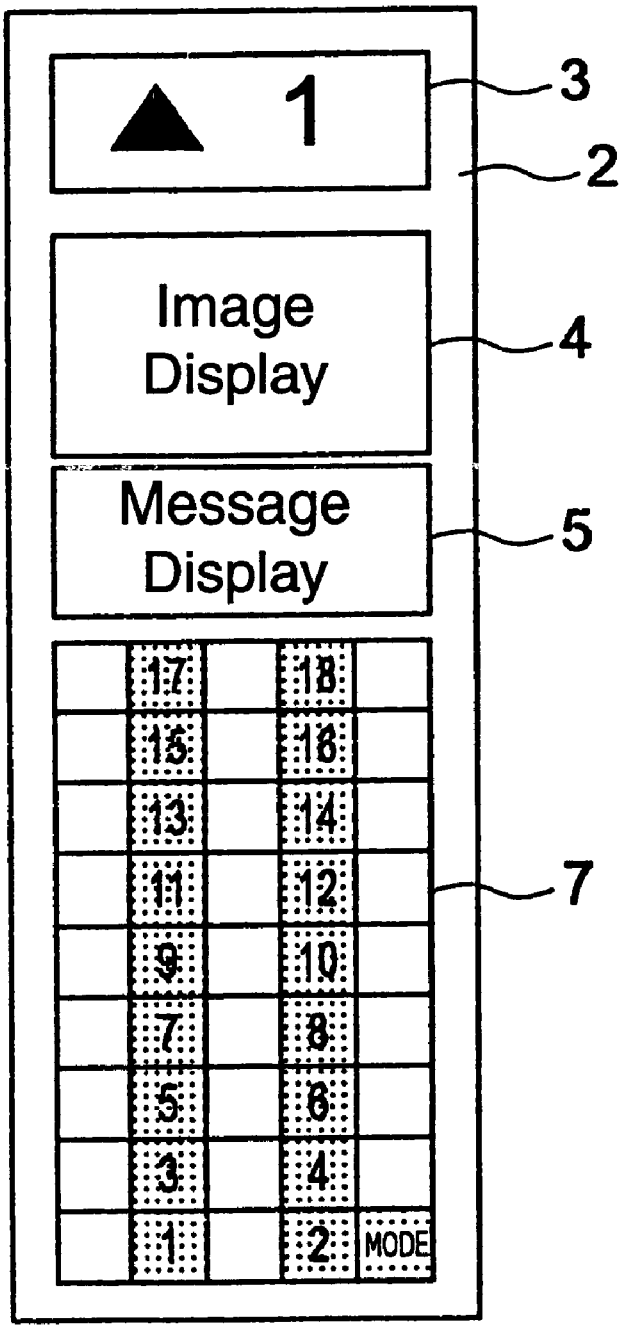
FIG. 7 is a front view showing the state where displayed contents are changed.

It should be noted that, the number and layout of the buttons in the button portion 7 is not limited to those of FIG. 1, for example, as shown in FIGS. 6 and 7, it is also possible that many buttons (forty five buttons in the figure) are previously arranged and the function of each button is allocated by changing the contents of the display.

What is claimed is:

1. An operating panel for an elevator comprising an operating panel body, and a touch panel portion including a button portion for inputting information, located at a front surface of said operating panel body, wherein said button portion includes:

a display surface member;

a button frame spaced from a surface of said display surface member, said button frame having a button accommodating portion;

a button cap embedded within said button accommodating portion, said button cap being operated by being pushed; and a metal dome member located between said button accommodating portion and said button cap, said dome member being deformed by being pressed by said button cap when said button cap is pushed and being restored when said button cap is released.

2. The operating panel for an elevator according to claim 1, wherein said button cap is transparent.

3. The operating panel for an elevator according to claim 1, including a through hole at a bottom portion of said button accommodating portion, wherein said button cap includes an operation projection inserted in the through hole, and said operation projection is moved toward said display surface member when said button cap is pushed.

4. The operating panel for an elevator according to claim 1, wherein a character is projected onto a surface of said button cap.

* * * * *